US006551148B1

(12) United States Patent
Sturgeon et al.

(10) Patent No.: US 6,551,148 B1
(45) Date of Patent: Apr. 22, 2003

(54) ELECTRICAL CONNECTOR WITH MINIMIZED NON-TARGET CONTACT

(75) Inventors: Scott D. Sturgeon, Vancouver, WA (US); David C. Johnson, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/004,053

(22) Filed: Oct. 19, 2001

(51) Int. Cl.[7] ..... H01R 4/48
(52) U.S. Cl. ..... 439/862; 439/660
(58) Field of Search ..... 439/660, 247, 439/500, 74, 248, 636, 862, 66

(56) References Cited

U.S. PATENT DOCUMENTS 5,676,559 A * 10/1997 Laub et al. ..... 439/260
5,921,813 A 7/1999 Patel et al.
5,980,313 A 11/1999 Kunishi et al.
5,984,450 A 11/1999 Becker et al.
5,984,457 A 11/1999 Taub et al.
6,033,064 A 3/2000 Pawlowski, Jr. et al.
6,050,666 A 4/2000 Yeoh et al.
6,068,507 A 5/2000 Popa

* cited by examiner

*Primary Examiner*—Renee Luebke
*Assistant Examiner*—Phuong-Chi Nguyen

(57) ABSTRACT

An electrical connector configured for minimized contact with a non-target structure of a target circuit, and a printing mechanism that uses the electrical connector for conductive connection between circuit portions of the printing mechanism. The connector includes a housing for positioning the connector in conductive contact with the target circuit. An electrically conductive contact filament is mounted on the housing and includes a proximal portion extending from the housing and a contact portion for electrically contacting the target circuit. An intermediate portion is formed to circumnavigate the non-target structure and joins the proximal and distal portions.

19 Claims, 2 Drawing Sheets

ELECTRICAL CONNECTOR WITH MINIMIZED NON-TARGET CONTACT

FIELD OF THE INVENTION

The present invention relates generally to electrical connectors, and more specifically to an electrical connector having a conductive contact configuration that minimizes non-target contact.

BACKGROUND

Electrical connectors are fundamental to routing electrical connections between separate electrical circuits. For example, information stored in a stand-alone memory component may be accessed by a processor after electrical connection is made through an electrical connector. Typically, this electrical connection is made by electrical contact with conductive contact pads on a target circuit. The electrical connector generally provides contact structures, such as resilient, conductive filaments, that are aligned with, and capable of, touching each of the contact pads.

In many cases, the target circuit includes contact pads that are directly connected to an integrated circuit, such as a memory chip fabricated by microlithography on a silicon wafer. A non-conductive, protective bead is often used to position the memory chip relative to the contact pads. The bead is commonly in the form of a polymerized organic resin, such as an epoxy resin. An epoxy bead stably adheres the memory chip to a substrate, in a precise conductive relation to contact pads formed on the substrate. Furthermore, the epoxy bead electrically insulates the memory chip from unwanted conductive connection and protects the memory chip from chemical, electrical, and physical damage.

Despite the important roles played by an epoxy bead, the presence of the bead may cause problems. For example, the epoxy bead is typically positioned immediately adjacent the contact pads of the target circuit, to minimize the size, and thus cost, of the target circuit. Therefore, as the connector or target circuit is positioned for conductive contact, one or more of the conductive contact structures of the connector may contact the epoxy bead, which usually occurs as a raised structure relative to the contact pads. This contact may occur during mating of the connector with a receptacle, or during positioning of the target circuit (for example, where the target circuit is on a removable module such as an ink supply of an inkjet printing mechanism such as a printer). The contact with an epoxy bead may preclude proper conductive contact between the connector and the appropriate contact pad(s) and/or may damage the memory chip under the epoxy bead.

Increasing the overall size of the target circuit allows the epoxy bead and contact pads to be spaced farther apart and tends to lessen the possibility of stable, non-conductive contact between the connector and the epoxy bead. However, increased spacing within the target circuit generally increases the cost of the target circuit. In particular, gold is commonly used to form each contact pad because of desirable properties of gold, such as high conductivity and low propensity for corrosion. With increased target circuit size, more gold will be required to form the contact pads.

More precise alignment between the conductive contact structures of the connector and the contact pads may help eliminate some of the undesired contact between the epoxy bead and the connector. For example, a positioning system for a connector is described in U.S. patent application Ser. No. 09/925,400 titled Electrical Connector with Biased Positioning, naming Scott D. Sturgeon and David C. Johnson as inventors, and filed Aug. 9, 2001, the subject matter of which is incorporated herein by this reference. However, a more precisely defined mated position of the connector may not be sufficient to avoid unwanted non-conductive and/or damaging contact with the epoxy bead when the epoxy bead is closely spaced from the contact pads or is substantially raised above the target circuit's surface. Therefore, an electrical connector capable of minimizing undesired contact with a non-conductive bead or other non-target structure would still be useful.

SUMMARY OF THE INVENTION

The present invention provides an electrical connector configured for minimized contact with non-target structures of a target circuit, and a printing mechanism that uses the electrical connector for conductive connection between circuit portions of the printing mechanism. The connector includes a housing for positioning the connector in conductive contact with the target circuit. An electrically conductive contact filament is mounted on the housing and includes a proximal portion extending from the housing and a contact portion for electrically contacting the target circuit. An intermediate portion is formed to circumnavigate the non-target structure and joins the proximal and distal portions.

DETAILED DESCRIPTION

The present invention provides an electrical connector configured to minimize the frequency of damaging and/or non-productive contact with a non-target structure that is positioned at or near a target circuit. The electrical connector may include a conductive contact structure with a geometry that minimizes the chance of contact with non-target structures. As a result, the geometry of the contact structure may increase the frequency of effective contact between the contact structure and the target circuit. Alternatively, or in addition, the electrical connector may be structured to reduce the magnitude of a potentially damaging contact force with a non-target structure. The force may be produced by temporary contact between the contact structure and the non-target structure during positioning of the connector relative to the target circuit.

Figure 1:
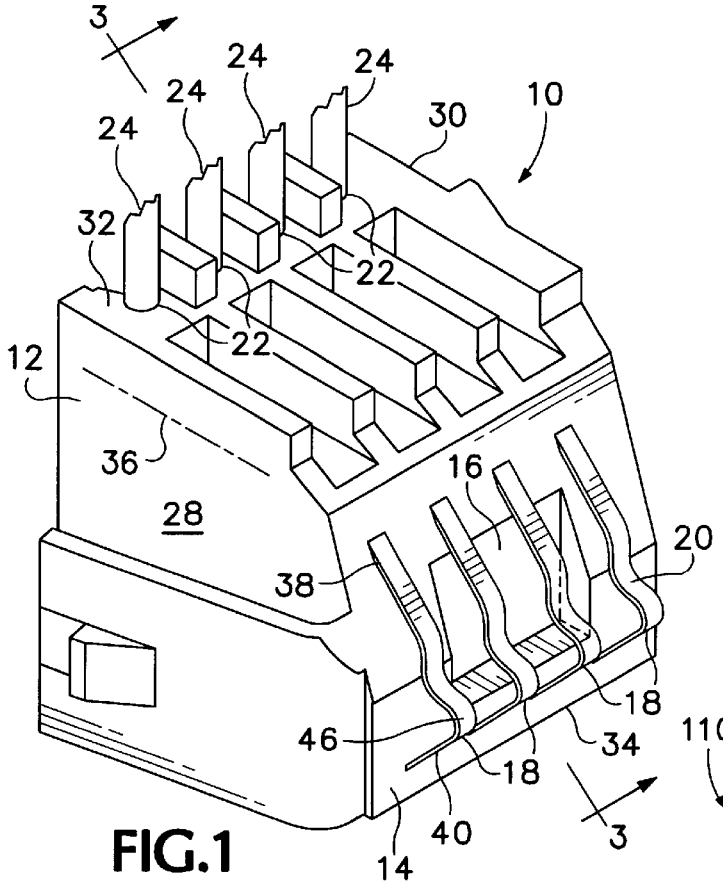
FIG. 1 is an isometric view of a connector according to one embodiment of the present invention.

FIG. 1 shows an example of a connector 10 produced according to one embodiment of the present invention.

Connector 10, for example, may take the form of a connector configured to contact a memory circuit mounted on an ink supply cartridge, in order to link the memory circuit to another circuit on a printing mechanism such as a printer, plotter, fax machine, etc.

As shown, connector 10 includes a housing 12 with a contact wall 14 with a recess 16 formed therein. Electrically conductive contact structures 18 extend rearward from the contact wall of the housing and define an avoidance region 20 on each contact structure. Avoidance region 20 may act to minimize non-productive contact between contact structure 18 and a non-target structure, as will be explained below. Recess 16 of contact wall 14 may function to increase the range of deformation available to a contact structure, the utility of which will become apparent upon reading further.

Housing 12 also defines electrical access locations 22, which provide internal conduits for electrical connection to contact structures 18. When connected to a target circuit, one or more of the contact structures 18 electrically connect conductors 24 to the target circuit. The conductors extend directly or indirectly to a second circuit (not shown) for electrical connection thereto. Thus, the connector functions by providing a conductive link between the target circuit and a second circuit.

Figure 2:
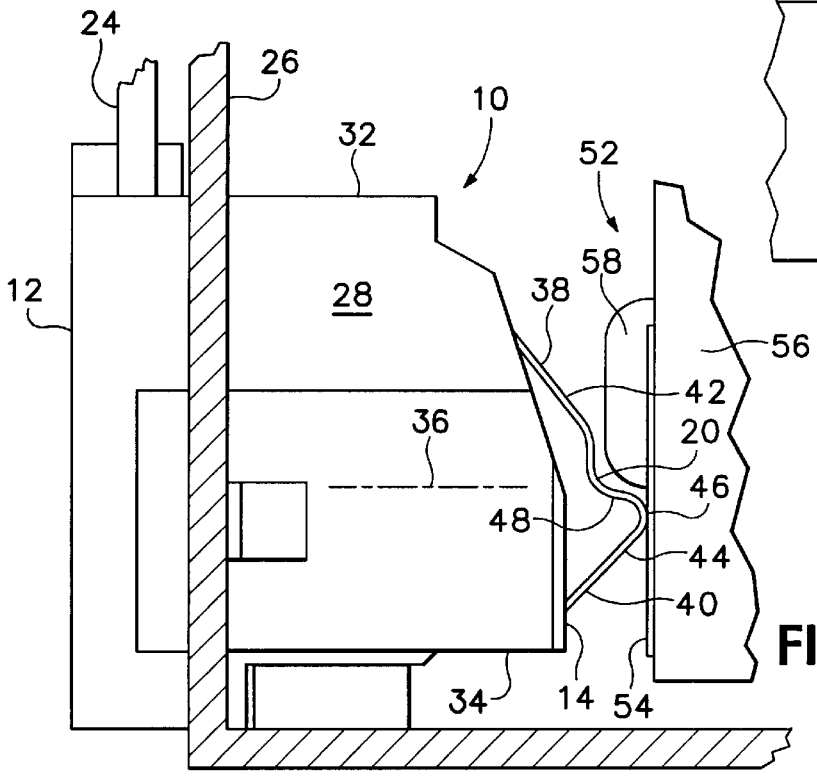
FIG. 2 is a side elevation view of the connector of FIG. 1 mated with a receptacle and contacting a target circuit, while avoiding a non-target structure positioned near the target circuit.

Housing 12 is generally configured for mating with a receptacle, such as receptacle 26 shown in FIG. 2. Mating is effective to reliably position the connector relative to the receptacle. Receptacle 26 thus may be dimensioned to receive and hold housing 12. Receptacle 26 therefore provides a mating structure for housing 12 to hold the connector in a constrained or fixed position. The receptacle thus may act as a direct positioning structure for defining position of connector 10, and may act as a direct or indirect positioning structure for a target circuit.

As shown in FIG. 1, housing 12 has an exterior region that may include first and second side walls 28 and 30, respectively, a top wall 32, and a bottom wall 34, in addition to contact wall 14. Long axis 36 of the connector extends generally parallel to the side, top and bottom walls and is generally normal to the contact wall and any contact plane defined by a target circuit. The housing may define fixed positioning/abutment structures, referred to as datums, and a biasing mechanism to fix the housing position relative to a receptacle. Examples of datums and a biasing mechanism for a connector that may be suitable are described in U.S. patent application Ser. No. 09/925,400 titled Electrical Connector with Biased Positioning, naming Scott D. Sturgeon and David C. Johnson as inventors, and filed Aug. 9, 2001, the subject matter of which is incorporated herein by this reference.

The housing also generally define relative spatial positions of access locations 22 and at least partially insulates electrical connections between access locations 22 and contact structures 18. Although any insulating material may be used, glass-filled polybutylene terephthalate has been found to be a suitable material for the housing, based on cost, dimensional stability,-chemical robustness, and mechanical properties.

A contact structure according to the present invention is any electrically conductive structure that extends from housing 12 in a non-linear path for physical contact with a conductive surface. The contact structures may have a generally arcuate geometry, but other geometries, such as angular or linear, may also be suitable. A contact structure is typically resilient and may be constructed of a non-corrosive conductive material. Furthermore, a contact structure may include gold, or be gold-plated. A connector according to the present invention generally includes multiple contact structures extending in a substantially parallel relationship.

A contact structure may take the form of an elongate conductive material, such as a strip or a wire, hereinafter referred to as a filament (an example of which is shown in contact structure 18 of FIG. 1). Each contact structure 18 has a first proximal portion 38 extending from the housing, and may include a second proximal portion 40, such as shown in connector 10. At least one region of each contact structure is secured to the housing, typically an end region adjacent a proximal portion, as described above. The end region may be secured by any suitable mechanism, including embedding the end region within the housing. In some cases, a first end region of a contact structure is fixed within the housing, and a second end region enters the housing but is movable within the housing in response to a contacting force on the contact structure. In this case, the second end region may be positioned in a guiding channel or aperture formed by the housing.

More distal portions of each contact structure are joined to the proximal portion. Each proximal portion extends to join an intermediate portion, such as intermediate portions 42 and 44, shown in FIGS. 2 and 4, which extend from proximal portions 38 and 40, respectively. In turn, each intermediate portion extends to join contact portion 46. Each intermediate portion may include an avoidance region 20, one of which is shown as part of intermediate portion 42. With a single avoidance region, a filament such as shown in connector 10 may be described as S-shaped. An avoidance region may be any region of an intermediate portion that circumnavigates a target structure. An avoidance region may include a concave or recessed structure. An acute region of the avoidance region, such as acute region 48, may form an angle with long axis 36 of less than approximately 20 degrees.

FIG. 2 illustrates how contact structures 18 of connector 10 may facilitate productive contact with a target circuit 52. As shown, target circuit 52 generally includes a plurality of conductive target contact pads 54 formed on a non-conductive substrate 56. Contact pads 54 typically are spaced to correspond to the spacing between contact structures 18 of the connector. The contact pads, it will be appreciated, are typically in conductive relation with a circuit component mounted on substrate 56 (not shown). The circuit component may be mounted with a non-conductive material, such as an epoxy resin. This produces a non-target structure 58 that may position, cover, and/or protect the underlying circuit component. Other examples of non-target structures include any other non-conductive or conductive structure that is proximate to a contact pad 54 and potentially physically interferes with proper conductive contact. For example, non-target structure 58 may be defined by a fastener, an adhesive, another electrical component, a component housing, a frame, or any other spatially interfering structure.

As shown in FIG. 2, contact portion 46 of contact structure 18 is in abutment with contact pad 54 of target circuit 52. In contrast, avoidance region 20 maintains a spaced relation with non-target structure 58, thus avoiding interfering contact.

Figure 3:
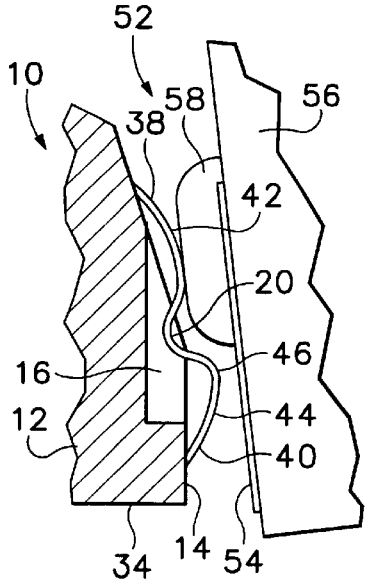
FIG. 3 is a fragmentary, partially sectional side elevation view of the connector of FIG. 1 viewed generally along line 3—3, illustrating temporary deformation contact structure into a recess of the connector by contact with a non-target structure of a target circuit, as the target circuit is being positioned.

FIG. 3 illustrates a role for recess 16 formed in contact wall 14. In this example, target circuit 52 is being positioned for conductive contact with connector 10. The connector has been previously mated with a receptacle to position the connector. To achieve a seated position for the target circuit, a user first positions the target circuit in a pre-seated configuration, with the upper portion tilted toward the connector, as shown. From this pre-seated configuration, clockwise rotation of the target circuit seats the target circuit, for example, as shown in FIG. 2.

In the pre-seated configuration shown in FIG. 3, the target circuit, especially non-target structure 58, may exert a significant force on intermediate portion 42 of a contact structure, generally normal to the intermediate portion and towards the connector. When the contact structure is resilient, the contact structure will tend to deform downward and inward toward the contact wall. In the absence of recess 16, the degree of contact structure deformation may be limited by contact between the intermediate portion and the housing. In contrast, as shown in FIG. 3, recess 16 allows greater deformation of the contact structure, so that the recess receives the contact structure. As a result, the magnitude of a damaging force exerted on the target circuit and/or connector may be substantially reduced.

Recess 16, shown in FIG. 1, is positioned to receive only the central two contact structures. However, a recess may be alternatively positioned and dimensioned to receive any number of contact structures in response to a force exerted on an intermediate portion toward the housing, generally normal to the intermediate portion. As indicated, a recess may be positioned and dimensioned based on the size and expected position of a non-target structure.

Figure 4:
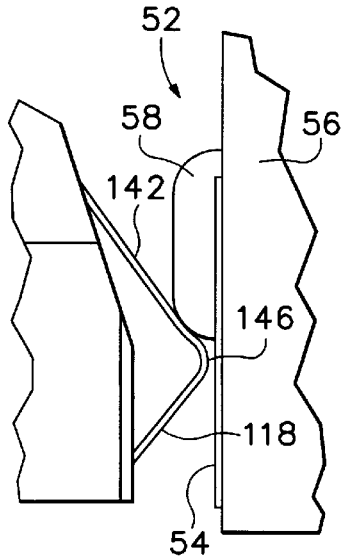
FIG. 4 is a fragmentary side elevation view of a connector and target circuit, illustrating a contact structure configuration that is blocked from conductive contact by a non-target structure near the target circuit.

For comparison with connector 10, an example of a contact structure lacking an avoidance region is shown in FIG. 4 with contact structure 118 mounted on connector 110. In this example, intermediate portion 142 contacts non-target structure 58, thus preventing abutment between contact portion 146 and contact pad 54.

Figure 5:
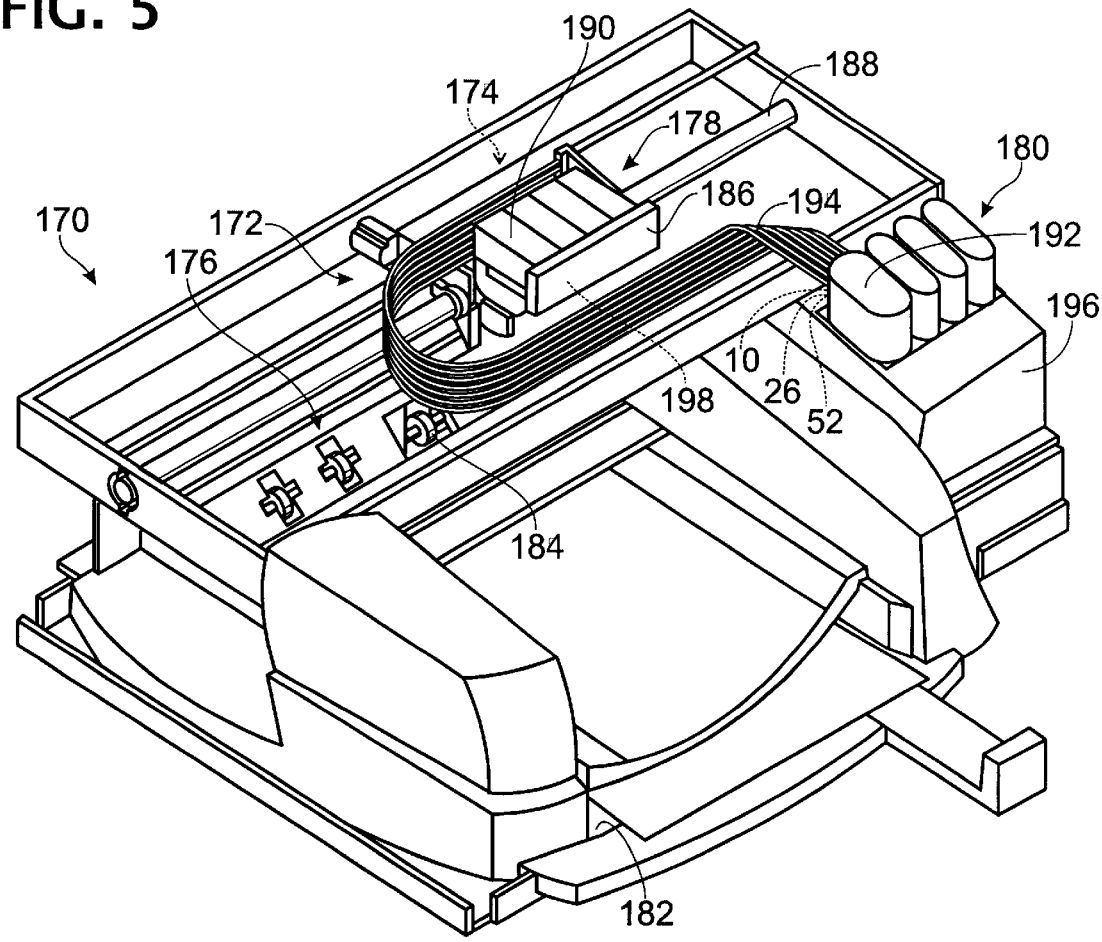
FIG. 5 is an isometric view of an inkjet printer that includes the connector, receptacle, and target circuit of FIG. 2.

Connector 10 may be used to provide conductive connection between circuits. For example, as shown in FIG. 5, connector 10 may be used in a printing mechanism such as inkjet printer 170 to provide conductive connection between circuit portions of the printer. It will be appreciated, however, that connector 10 may similarly be used in a variety of other printing mechanisms, including plotters, faxes, etc. Printer 170 generally includes an ink delivery system 172 and a control circuit 174. Ink delivery system 172 includes all mechanical assemblies and structures that function to positionally expel ink onto print media. In contrast, control circuit 174 regulates operation of the ink delivery system as detailed below.

Ink delivery system 172 generally includes a media positioning mechanism 176, an ink application mechanism 178, and an ink supply mechanism 180. Positioning mechanism 176 positions print media relative to ink application mechanism 178, and ink application mechanism 178 applies ink provided by ink supply mechanism 180.

Positioning mechanism 176 feeds print media into position before and during printing. Positioning mechanism 176 may include a media tray 182 configured to hold print media, which is fed into printer 170. Positioning mechanism 176 may also include one or more rollers 184 or other media movement structures for moving print media from media tray 182 to various printing positions relative to ink application mechanism 178, and for moving print media out of printer 170 once printing has been completed. Furthermore, while the depicted printer 170 is configured to print on sheet media, a printer using an electrical connector according to the present invention may be configured to print on any other desired type of media without departing from the scope of the present invention.

Ink application mechanism 178 generally includes any mechanism for applying ink to print media. Mechanism 178 may include a carriage 186 that reciprocates along a scanning axis determined by carriage support rail 188. One or more printheads 190 may be mounted on carriage 186 for expelling ink onto print media. Carriage 186 and carriage support rail 188 may-support and facilitate positioning of printhead 190 relative to print media.

Ink supply mechanism 180 generally includes any mechanism that stores ink and provides ink to application mechanism 178. Ink application mechanism 180 may include a plurality of ink supplies 192 containing ink for printing. Ink supply mechanism 180 of the depicted embodiment is configured to hold four ink supplies 192, one for black ink and one for each of the primary colors. However, ink supply mechanism 180 may hold either more or fewer ink supplies, depending upon whether the printer is configured to print in color or only black-and-white, and how the printer mixes inks to form colors. Supply mechanism 180 may also include ink conduits 194 that provide fluid connection between ink supply mechanism 180 and ink application mechanism 178. Ink supply mechanism 180 of the depicted embodiment is positioned at a location remote from the printheads, referred to as "off-axis". However, each ink supply 182 may also be positioned on carriage 186 and also may be formed integrally with a printhead. Other examples of inkjet printers and printing systems that may be suitable for use in the present invention are described in U.S. Pat. No. 5,984,450 issued to Becker et al., Nov. 16, 1999; U.S. Pat. No. 5,984,457 issued to Taub et al., Nov. 16, 1999; U.S. Pat. No. 6,033,064 issued to Pawlowski et al., Mar. 7, 2000; and U.S. Pat. No. 6,050,666 issued to Yeoh et al., Apr. 18, 2000, each of which is incorporated by reference herein.

Control circuit 174 generally includes one or more electrically interconnected circuit portions that regulate aspects of ink delivery system 172. Circuit portions may regulate any aspect of communication with an external processor or any other aspect of ink delivery system 172 including media positioning mechanism 176, ink application mechanism 178, and ink supply mechanism 180. For example, circuit portions may determine print media movement and may sense aspects of the print media, such as presence or absence, quantity, size, quality, manufacturer, and the like. Circuit portions may also determine or sense various aspects of the ink application mechanism, such as carriage position and movement, printhead use, printhead firing pattern, ink drop size, printhead cleaning, printhead sensing, and the like. Furthermore, circuit portions may also determine or sense various aspects of the ink supply mechanism. For example circuit portions may store and/or sense ink supply parameters, such as date or site of manufacture, flow rate, or ink volume, viscosity, formulation, or color. Furthermore, circuit portions may also be used to signal presence or absence of ink supply 192.

The control circuit may include circuit portions that act as processors or memory devices. For example, printer 170 may include a main processor circuit, a carriage processor circuit, a printhead circuit, an ink supply circuit, and/or any other circuits that regulate an aspect of the ink delivery system. In the example of FIG. 5, connector 10 is mated with receptacle 26 provided by body 196 of printer 170. Connector 10 conductively contacts circuit portion 52 on ink supply 182, providing electrical connection between ink supply target circuit 52 and another circuit portion, carriage circuit 198, which in this case is a processor on carriage 186. However, connector 10 may mate with any receptacle that positions the electrical connector for conductive contact with any circuit portion that is configured to regulate ink delivery system 172. For example, connector 10 may conductively contact a carriage processor circuit, a main processor circuit, a printhead circuit, and the like, and thus may provide electrical connection between any of these circuit portions.

The disclosure set forth above may encompass multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An electrical connector configured for minimized contact with a protruding non-target structure of a target circuit, the connector comprising:

a housing adapted to position the connector for conductive contact with the target circuit; and an electrically conductive contact filament mounted on the housing, the contact filament including a proximal portion extending from the housing, a contact portion adapted to contact the target circuit, and an intermediate portion joining the proximal portion and the contact portion, the intermediate portion being formed to generally follow a contour of the protruding non-target structure when the contact portion contacts the target circuit.

2. The electrical connector of claim 1, wherein the intermediate portion includes a concave region.

3. The electrical connector of claim 1, wherein the filament includes first and second intermediate portions that flank the contact portion to define an S-shaped filament.

4. The electrical connector of claim 1, wherein the housing includes a contact wall adapted to oppose the target circuit, a long axis generally orthogonal to the contact wall, and the intermediate portion includes a region that forms an angle with the long axis of less than approximately 20 degrees.

5. The electrical connector of claim 1, wherein the housing defines a recess, the intermediate portion being adapted to be at least partially received by the recess in response to a filament deforming force exerted on the intermediate portion by contact with the non-target structure and further adapted to be external to the recess when the contact portion contacts the target circuit.

6. A connector assembly configured to electrically connect a circuit component to a second circuit, the assembly comprising:

a target circuit including the circuit component, a substrate, a non-target structure mounting the circuit component on the substrate and protruding from the substrate, and a conductive contact pad formed on the substrate in conductive connection with the circuit component; and an electrical connector including a housing adapted to position the connector for conductive contact with the contact pad, and an electrically conductive contact filament mounted on the housing, the contact filament including a proximal portion extending from the housing, a contact portion adapted to contact the contact pad, and an intermediate portion joining the proximal portion and the contact portion, the intermediate portion being formed to generally follow a contour of the protruding non-target structure when the contact portion contacts the contact pad.

7. The connector assembly of claim 6, wherein the intermediate portion includes a concave region.

8. The connector assembly of claim 6, wherein the filament includes first and second intermediate portions that flank the contact portion to define an S-shaped filament.

9. The connector assembly of claim 6, wherein the housing includes a contact wall adapted to oppose the target circuit, and the contact wall defines a recess adapted to at least partially receive the intermediate portion in response to a filament deforming force exerted on the intermediate portion, generally normal to the intermediate portion and towards the housing.

10. A printing mechanism, comprising:

an ink delivery system configured to positionally expel ink onto print media;

a control circuit configured to regulate the ink delivery system, the control circuit including plural circuit portions, one of the plural circuit portions being a target circuit, the target circuit including a circuit component, a substrate, a non-target structure mounting the circuit component on the substrate and protruding from the substrate, and a conductive contact pad formed on the substrate in conductive connection with the circuit component; and an electrical connector for conductive connection between the target circuit and at least one of the plural circuit portions other than the target circuit, the electrical connector including a housing adapted to position the connector for conductive contact with the target circuit; and an electrically conductive contact filament mounted on the housing, the contact filament including a proximal portion extending from the housing, a contact portion adapted to contact the contact pad, and an intermediate portion joining the proximal and contact portions, the intermediate portion being formed to generally follow a contour of the protruding non-target structure when the contact portion contacts the contact pad.

11. The printing mechanism of claim 10, wherein the ink delivery system includes a carriage and a printhead.

12. The printing mechanism of claim 10, wherein at least one of the plural circuit portions is selected from the group consisting of a main processor, a carriage processor, an ink supply circuit, and a printhead circuit.

13. The printing mechanism of claim 10, wherein the intermediate portion includes a concave region.

14. The printing mechanism of claim 10, wherein the filament includes first and second intermediate portions that flank the contact portion to define an S-shaped filament.

15. The printing mechanism of claim 10, wherein the housing includes a contact wall adapted to oppose the target circuit, and the contact wall defines a recess adapted to at least partially receive the intermediate portion in response to a filament deforming force exerted on the intermediate portion, generally normal to the intermediate portion and towards the housing.

16. A method of placing a connector in conductive contact with a target circuit while minimizing contact with a protruding non-target structure of the target circuit, comprising:

positioning the connector by mating with a receptacle, the connector including a housing adapted to position the connector for conductive contact with the target circuit, and an electrically conductive contact filament mounted on the housing, the contact filament including a proximal portion extending from the housing, a contact portion adapted to contact the target circuit, and an intermediate portion joining the proximal and contact portions, the intermediate portion being formed to generally follow a contour of the protruding non-target structure when the contact portion contacts the contact pad; and contacting the target circuit conductively with the contact filament.

17. The method of claim 16, wherein the intermediate portion includes a concave region.

18. The method of claim 16, wherein the filament includes first and second intermediate portions that flank the contact portion to define an S-shaped filament.

19. The method of claim 16, wherein positioning includes deforming the filament through contact between the non-target structure and the filament.

* * * * *